US011135493B2

(12) United States Patent
Fransson

(10) Patent No.: US 11,135,493 B2
(45) Date of Patent: Oct. 5, 2021

(54) SYSTEMS FOR FACILITATING PRACTICE OF BOWLING AND RELATED METHODS

(71) Applicant: Swift Tech Interactive AB, Örebro (SE)

(72) Inventor: Eddy Fransson, Kumla (SE)

(73) Assignee: Swift Tech Interactive AB, Örebro (SE)

( * ) Notice: Subject to any disclaimer, the term of this patent is extended or adjusted under 35 U.S.C. 154(b) by 138 days.

(21) Appl. No.: 16/359,566

(22) Filed: Mar. 20, 2019

(65) Prior Publication Data

US 2019/0217175 A1 Jul. 18, 2019

(51) Int. Cl.

| | |
|---|---|
| ***A63B 69/00*** | (2006.01) |
| ***A63D 5/04*** | (2006.01) |
| ***A63B 71/06*** | (2006.01) |

(52) U.S. Cl.

CPC ..... *A63B 69/0046* (2013.01); *A63B 71/0622* (2013.01); *A63D 5/04* (2013.01); *A63B 2243/0054* (2013.01); *A63D 2005/042* (2013.01)

(58) Field of Classification Search

None

See application file for complete search history.

(56) References Cited

U.S. PATENT DOCUMENTS

| | | | | |
|---|---|---|---|---|
| 4,982,601 | A * | 1/1991 | Troxell | A63D 1/00 73/104 |
| 8,292,733 | B2 | 10/2012 | Crawford et al. | |
| 8,992,315 | B2 | 3/2015 | Lundback et al. | |
| 2013/0324272 | A1* | 12/2013 | Vaioli | A63D 5/04 473/70 |

OTHER PUBLICATIONS

Clutch Bowling—On Lane Projection and Tracking System; Feb. 20, 2018; https://www.youtube.com/watch?v=RV6Wszpe9PA, [retrieved on Jun. 26, 2019].

Events—Clutch Bowling: What's Been Going on; 2018; 7 pages; http://clutchbowling.com/events/ [retrieved on Jun. 26, 2019].

Kegel Training Center—"Go Bowling! PBA Tour Premieres Sunday Dec. 23 on FOX"; Press Release provided by FoxSports; Dec. 19, 2019; 7 pages; http://www.kegeltrainingcenter.com/news/2018/12/19/go-bowling-pba-tour-premieres-sunday-on-fox [retrieved on Jul. 15, 2019].

(Continued)

*Primary Examiner* — Kevin Y Kim

(74) *Attorney, Agent, or Firm* — Brake Hughes Bellermann LLP

(57) ABSTRACT

The present inventive concept relates to a system, and related methods, for facilitating practice of bowling, wherein the system comprises: a data storing device configured to store oil pattern data corresponding to a set of oil patterns for bowling lanes; a projecting arrangement configured to project graphics onto a bowling lane; and a processing unit configured to send, from the data storing device to the projecting arrangement, oil pattern data corresponding to one oil pattern of said set of oil patterns, whereby graphics representing the one oil pattern of said set of oil patterns is projected onto the bowling lane.

15 Claims, 3 Drawing Sheets

(56) References Cited

OTHER PUBLICATIONS

Clutch Bowling Launches New Product Compatible with Kegel's Specto; Jul. 16, 2018; 3 pages; https://www.spectobowling.com/news/2018/7/16/clutch-bowling-launches-new-product-compatible-with-kegels-specto [retrieved on Jun. 26, 2019].

"Go Bowling! PBA Tour on Fox Introduces Specto Strike Track Technology"; Jan. 15, 2019; FOX PBA; 4 pages; https://www.spectobowling.com/news/2019/1/15/go-bowling-pba-tour-on-fox-introduces-specto-striketrack-technology [retrieved on Jun. 26, 2019].

Vithayathil; "On the Go With Joe at Clutch Bowling"; Fox 12 Oregon; Oct. 1, 2018; 2 pages; https://www.kptv.com/good_day_oregon/on_the_go_with_joe/on-the-go-with-joe-at-clutch-bowling/article_36f74a9c-c595-11e8-ae28-277710281d86.html [retrieved on Jun. 26, 2019].

* cited by examiner

SYSTEMS FOR FACILITATING PRACTICE OF BOWLING AND RELATED METHODS

TECHNICAL FIELD

The inventive concept described herein generally relates to bowling and more specifically to systems and methods for facilitating practice of bowling.

BACKGROUND

Bowling is a popular sport at both the leisure and competitive levels. People at all levels often strive to improve their technique. There are for example gloves used to improve the technique of the bowler and aid the bowler when practicing the sport (e.g. see U.S. Pat. Nos. 3,038,723A, 4,407,499A and 3,606,319A).

Oiling of lanes is crucial to have the bowling balls to act as expected and the action of oiling the lanes are performed regularly in order make sure the lanes are properly oiled. The oil is applied in certain patterns and the pattern may vary with a more or less common feature with no oil at the end of the lane, closest to the pins, in order for the spinning balls to increase its traction to the surface on which it rolls. This enables for the bowling ball to make a direction change according to the spin of the bowling ball. This point of change of direction is referred to as the breakpoint.

Since the implementation of automatized bowling systems and the use of displays in bowling facilities, feedback of game related information to the players is provided but limited to for example knocked down pins, the position of the remaining pins and the scoreboard.

U.S. Pat. No. 8,292,733 discloses a system for visually enhancing a game structure, for example a bowling game. The system includes a projector and a tracking arrangement that projects themed images onto the game surface.

SUMMARY OF THE INVENTION

It is an object of the present inventive concept to mitigate, alleviate or eliminate one or more of the above-identified deficiencies in the art and disadvantages singly or in combination.

According to a first aspect of the inventive concept, these and other objects are achieved in full, or at least in part, by a system for facilitating practice of bowling, wherein the system comprises: a data storing device configured to store oil pattern data corresponding to a set of oil patterns for bowling lanes; a projecting arrangement configured to project graphics onto a bowling lane; and a processing unit configured to send, from the data storing device to the projecting arrangement, oil pattern data corresponding to one oil pattern of said set of oil patterns, whereby graphics representing the one oil pattern of said set of oil patterns is projected onto the bowling lane.

The player may thus more clearly achieve an understanding of the oil pattern and its effect on the bowling ball and may be to adapt his or her gameplay accordingly.

The system may further comprise a tracking arrangement configured track movement of a bowling ball on the bowling lane and to generate tracking data corresponding to a bowling ball trajectory; wherein the processing unit is further configured to compare the tracking data to the oil pattern data and to update the oil pattern data in the data storing device based on the comparison, the updated oil pattern data corresponding to an adjusted oil pattern; and wherein the processing unit is configured to send, from the data storing device to the projecting arrangement, the updated oil pattern data, whereby graphics representing the adjusted oil pattern is projected onto the bowling lane.

Hereby, the oil pattern and the projection of the same may be updated with respect to the interaction between a bowling ball and the oil pattern. A player may thus be provided with a more accurate oil pattern and be able adapt his or her gameplay to adjusted oil pattern. This may also provide for facilitated maintenance, to give an understanding of when to apply new oil to the lane.

According to a second aspect of the inventive concept, the earlier mentioned objects are achieved in full, or at least in part, by a system for facilitating practice of bowling, wherein the system comprises: a data storing device configured to store intended trajectory data corresponding to an intended bowling ball trajectory; a projecting arrangement configured to project graphics onto a bowling lane; and a processing unit configured to send, from the data storing device to the projecting arrangement, intended trajectory data corresponding to at least part of the intended bowling ball trajectory, whereby graphics representing at least part of the intended bowling ball trajectory is projected onto the bowling lane.

Hereby, a player may be provided with information regarding for example, where to aim the bowling ball, the intended ball trajectory or parts thereof or other points or areas along the ball trajectory that are of importance, which in turn may provide for enhanced bowling practicing capabilities.

The system may further comprise: a tracking arrangement configured track movement of a bowling ball on the bowling lane and to generate tracking data corresponding to a bowling ball trajectory. Hereby, movement of the bowling ball on the bowling lane may be tracked.

The system may be further configured to compare the intended trajectory data to the tracking data and to, based on the comparison, generate accuracy data; and wherein the system further comprises: an interface configured to present the generated accuracy data.

Hereby, the system may be capable of comparing the actual bowling ball trajectory to the intended bowling ball trajectory and for the user to get an understanding of how accurate (e.g. how close to the intended ball trajectory) the actual bowling ball trajectory was.

The accuracy data may represent a deviation in the bowling ball trajectory to the intended bowling ball trajectory.

The processing unit may be further configured to send, from the tracking arrangement to the projecting arrangement, tracking data corresponding to at least part of the bowling ball trajectory, whereby graphics representing at least part of the bowling ball trajectory is projected onto the bowling lane simultaneously with the graphics representing at least part of the intended bowling ball trajectory.

Hereby, the system may indicate to the user visually, at least part of the actual bowling ball trajectory in relation to at least part of the intended ball trajectory. Preferably this indication is done covering the whole trajectory and/or more preferably covering different points or areas along the ball trajectory of certain importance to the player.

The system may further comprise a graphical user interface configured to receive, by a user, input data defining the intended bowling ball trajectory; wherein the data storing device is further configured to store the input data defining the intended bowling ball trajectory as intended trajectory data.

Hereby, a user may provide input regarding how the intended ball trajectory should look. The user may draw a desired trajectory and/or select input parameters generating an intended trajectory. The input parameters may for example be related to curvature of the trajectory, ball weight, a breakpoint, and/or speed of the bowling ball. The desired ball trajectory may also be selected from a database comprising a plurality of different trajectories.

The processing unit may be further configured to send, from the tracking arrangement to the graphical user interface, tracking data corresponding to at least part of the bowling ball trajectory and, from the data storing device to the graphical user interface, intended trajectory data corresponding to at least part of the intended bowling ball trajectory, whereby graphics representing at least part of the bowling ball trajectory and graphics representing at least part of the intended bowling ball trajectory are displayed on the graphical user interface.

Hereby, a user may be provided with visual feedback via the graphical user interface. The graphical user interface may provide a clear overview of the bowling ball trajectory and how relates to the intended ball trajectory. Preferably this indication is done covering the whole trajectory and/or more preferably different points and/or areas along the ball trajectory of certain importance to the player.

The processing unit may be further configured to send, from the tracking arrangement to a display, tracking data corresponding to at least part of the bowling ball trajectory and, from the data storing device to the display, intended trajectory data corresponding to at least part of the intended bowling ball trajectory, whereby graphics representing at least part of the bowling ball trajectory and graphics representing at least part of the intended bowling ball trajectory are displayed on the display.

Hereby, a user may be provided with visual feedback via the graphical user interface. The graphical user interface may provide a clear overview of the bowling ball trajectory and how relates to the intended ball trajectory. Preferably this indication is done covering the whole trajectory and/or more preferably different points and/or areas along the ball trajectory of certain importance to the player.

The intended trajectory data corresponding to an intended bowling ball trajectory may comprise a breakpoint of the bowling ball when moving on the bowling lane.

In general, with respect to U.S. Pat. No. 8,292,733, the inventive concept according to the aspects disclosed herein may provide e.g. visual feedback allowing a user to understand the properties of a bowling lane (e.g. in the case of projecting an oil pattern of the bowling lane), and further may provide e.g. feedback regarding an intended bowling ball trajectory, optionally related to a tracked bowling ball trajectory. By providing such feedback directly on the bowling lane, both regarding properties of the bowling lane and regarding an intended bowling ball trajectory, optionally related to a tracked bowling ball trajectory, a deeper understanding of the bowling game may be provided to a player, and hence practice of bowling may be facilitated.

A feature described in relation to one aspect may also be incorporated in other aspects, and the advantage of the feature is applicable to all aspects in which it is incorporated.

Other objectives, features and advantages of the present inventive concept will appear from the following detailed disclosure, from the attached claims as well as from the drawings.

Generally, all terms used in the claims are to be interpreted according to their ordinary meaning in the technical field, unless explicitly defined otherwise herein. Further, the use of terms "first", "second", and "third", and the like, herein do not denote any order, quantity, or importance, but rather are used to distinguish one element from another. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present inventive concept, will be better understood through the following illustrative and non-limiting detailed description of different embodiments of the present inventive concept, with reference to the appended drawings, wherein.

The figures are not necessarily to scale, and generally only show parts that are necessary in order to elucidate the inventive concept, wherein other parts may be omitted or merely suggested.

DETAILED DESCRIPTION

The present disclosure relates to bowling and more specifically system and method for facilitate bowling practice and improved gameplay. Initially, some terminology may be defined to provide clarification for the following disclosure.

The term 'breakpoint' may in the context of the present disclosure refer to a point along the bowling ball trajectory wherein a tangent to the bowling ball trajectory is parallel to a longitudinal extension of the bowling lane. It is to be understood that even though the term itself refers to a point, the breakpoint may also be defined as an area, or the like.

The term 'sending' in the context of the present disclosure may be understood as either sending directly from the first referred entity to the second referred entity, or as sending from the first referred entity, via an intermediate entity (e.g. a processing unit), to the second referred entity.

Figure 1:
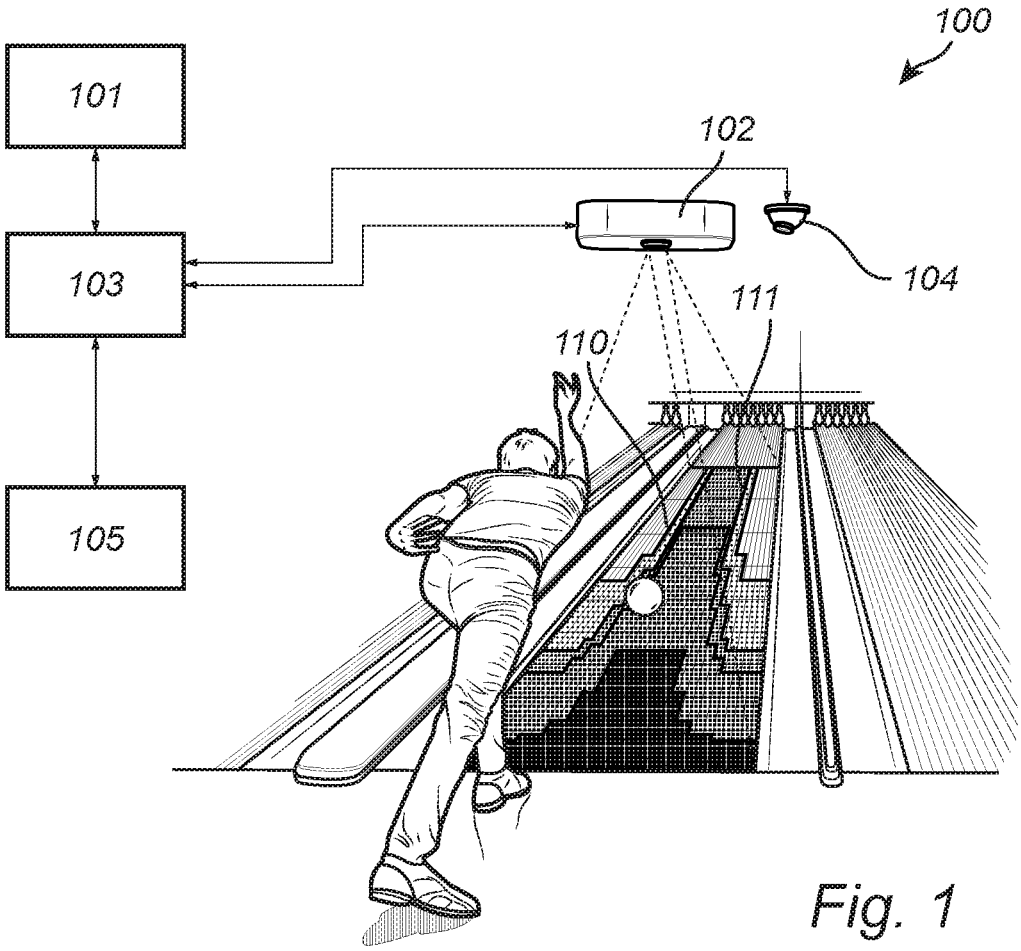
FIG. 1 schematically illustrates a system according to a first aspect of the inventive concept.

FIG. 1 illustrates a system 100 for facilitating bowling practice and improving gameplay. The system 100 comprises a projecting arrangement 102 configured to project graphics onto a bowling lane 110. The graphics here represents an oil pattern 111 to indicate to the player the appearance and the type of the oil pattern applied onto the bowling lane 110. The oil pattern may be entered into the system 100 and stored in a data storing device 101 in the form of oil pattern data. For example, oil pattern data may be entered and stored in the data storing device 101 when a new oil pattern is applied to the bowling lane. Several oil patterns may be stored as a set of oil patterns in the storing device 101. The system 100 further comprises a processing unit 103 configured to send oil pattern data corresponding to one oil pattern from the storing device 101 to the projecting arrangement. The processing unit 103 may identify the correct oil pattern 111 from the set of oil patterns for the bowling lane 110 and send data corresponding to the identified oil pattern 111 from the data storing device 101 to the projecting arrangement 102, thus causing the projecting arrangement 102 to project graphics representing the oil pattern onto the bowling lane.

Optionally or additionally, the oil pattern can be presented to the player by an interface 105, preferable this is a display, user interface, graphical user interface, and/or mobile device.

The system 100 may further comprise a tracking arrangement 104 configured track movement of a bowling ball on the bowling lane and to generate tracking data corresponding to a bowling ball trajectory. The processing unit 103 may further be configured to compare the tracking data to the oil pattern data and to update the oil pattern data in the data storing device based on the comparison, the updated oil pattern data corresponding to an adjusted oil pattern. The processing unit 103 may be configured to send, from the data storing device to the projecting arrangement 102, the updated oil pattern data, whereby graphics representing the adjusted oil pattern is projected onto the bowling lane.

An initial calibration may be performed in order to have the projecting arrangement 102 and/or tracking arrangement 104 aligned with the bowling lane 110. Optionally, the alignment and/or mapping, is performed continuously by projecting known calibration targets for the tracking arrangement 104 to find. To find the boundaries of the bowling lane 110, image recognition may be used. The calibration as such is not explained in more detail and is considered to be known to a person skilled in the art. Hence, the calibration may be performed in other ways not further discussed in the present disclosure.

Bowling balls traveling along the bowling lane 110 may affect the oil pattern on the bowling lane 110. Some of the oil in the oiled area may for example stick to the bowling ball and be transported to the non-oiled area or continue to be attached to the bowling ball, resulting in changes of the applied oil pattern over time. For example, a length of the oil pattern may be extended. Further, some areas of the bowling lane 110 which previously did not have oil applied may be provided with oil. Similarly, some areas of the bowling lane which previously had oil applied may have less or no oil applied. Hence, the initially entered data for the oil pattern may not be a correct visualization of the actual oil pattern present. By tracking the bowling balls and generating an updated oil pattern, adjusted for the effect of the bowling balls, a new updated oil pattern is generated and projected via the projecting arrangement 102.

Optionally, the tracking arrangement 104 may determine the location of the bowling balls and, based on the number of bowling balls passing and their location traveling along the lane, an indication of the need of updating the oil pattern may be generated. For instance, if a certain amount of bowling balls has traveled along the bowling lane 110 and all have been moving along substantially the same path, there may be a need of applying new oil at an earlier stage than in a case having the bowling ball evenly spread along the width of the lane for the same amount of bowling balls. I.e the system may be able to, based on the amount of bowling balls and their position, indicate that oil need to be applied to the bowling lane 110.

The system 100 may store trajectories of bowling balls and keep track of the order of which they are moved along the bowling lane. From this data the system 100 may create a heat map of the bowling ball trajectories and an estimation of the impact of the number of bowling balls on the oil pattern may be generated by the processing unit 103. The system 100 may calculate a new updated oil pattern based on each bowling ball traveling along the bowling lane 110. This estimation may be based on the previous oil pattern 111, the bowling ball trajectory and/or a factor defining the effect each bowling ball has on the oil along the bowling ball trajectory. The latter, meaning having a certain amount of oil sticking to the bowling ball moving over the oiled surface and later having part of that amount released from the bowling ball when the bowling ball moves along the non-oiled surface.

Figure 2:
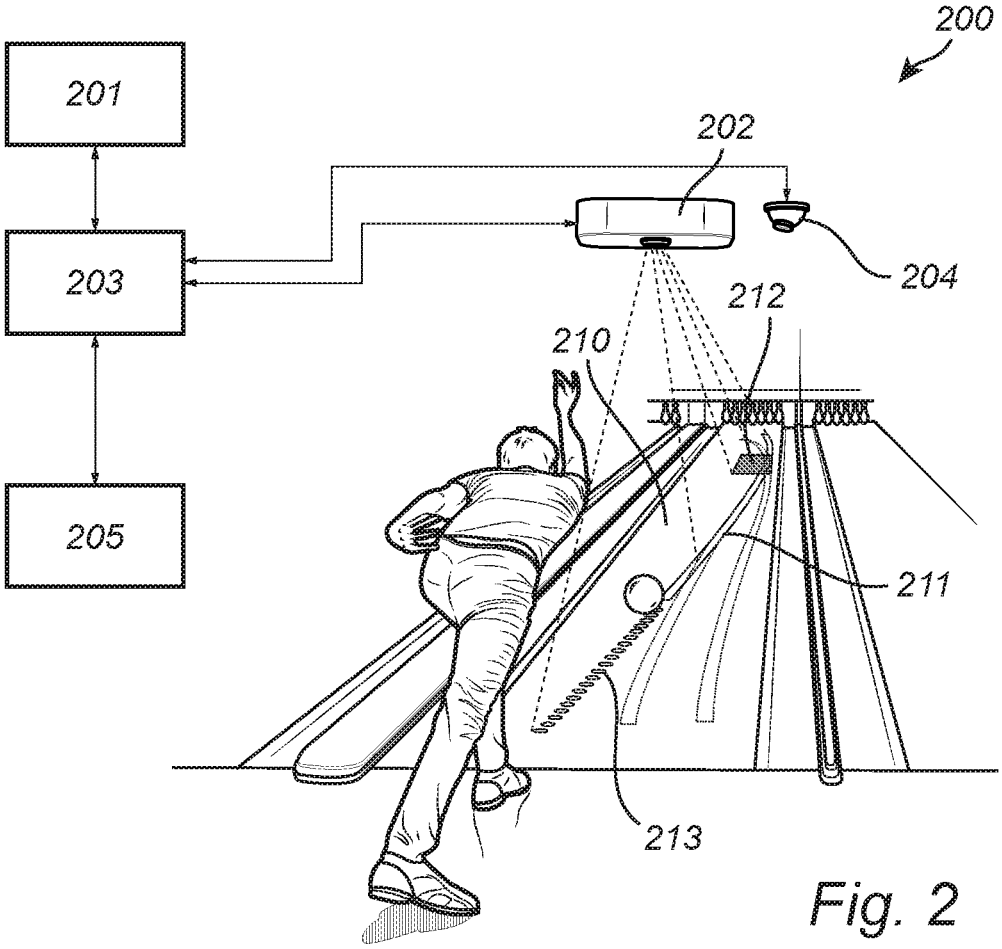
FIG. 2 schematically illustrates a system according to a second aspect of the inventive concept.

FIG. 2 illustrates a system 200 for facilitating bowling practice. The system 200 comprises a projecting arrangement 202 configured to project graphics onto a bowling lane 210. The graphics comprises trajectory data associated with an intended bowling ball trajectory 211, 212 to indicate to the player a desired path of the bowling ball. The system also comprises a processing unit configured to send, from the data storing device to the projecting arrangement 202, intended trajectory data corresponding to at least part of the intended bowling ball trajectory, whereby graphics representing at least part of the intended bowling ball trajectory 211, 212 is projected onto the bowling lane 210.

The data associated with an intended bowling ball trajectory 211, 212 may be the whole intended bowling ball trajectory or part of the intended bowling ball trajectory. This may be automatically selected, or selected by the user, from a database of trajectories preferably stored in the data storing device 201. The intended bowling ball trajectory may also be calculated from the actual pin positions and may be presented as multiple options to the user for the user to select one from. The intended ball trajectory or part of the intended ball trajectory may be presented on the bowling lane 210 and/or an interface, where an interface is for example a user interface, a graphical user interface, a display, a mobile device and/or loudspeaker. The intended bowling ball trajectory 211, 212 may be presented as e.g. lines, dashed lines, squares and/or points. However, it is further envisioned that other shapes or graphics may be utilized to visualize the intended bowling ball trajectory 211, 212. The graphics may also include animations, such as changing colors or flashing lights to provide graphics being more easily identifiable.

The user may, via e.g. a graphical user interface, define a desired intended bowling ball trajectory 211, 212 and/or input data generating an intended bowling ball trajectory 211, 212, wherein the input data may for example be related to curvature of the trajectory, ball weight and/or speed of the bowling ball. The input data may also be specific points along the path that are of importance to the player, such as a starting point, a breakpoint and/or a point of impact to the pins.

The system 200 may also comprise a tracking arrangement 204 configured track movement of a bowling ball on the bowling lane 210 and to generate tracking data corresponding to a bowling ball trajectory 211, 212. The processing unit 203 may be configured to compare the intended trajectory data to the tracking data and to, based on the comparison, generate accuracy data. The generated accuracy data may be presented via an interface 205, where an interface may for example be a user interface, display, graphical user interface, mobile device and/or loudspeaker. The accuracy data may represent a deviation in the bowling ball trajectory to the intended bowling ball trajectory 211, 212. This may be a presentation of the whole bowling ball trajectory or just parts thereof on preferably points along the bowling ball trajectory of certain importance to the user, wherein the points of certain importance may be for example the breakpoint 212, start of trajectory and/or point of impact at the pins. This may also be a presentation of a mean value of the deviation along the trajectory representing the deviation.

The processing unit 203 may be further configured to send, from the tracking arrangement 204 to the projecting arrangement 202, tracking data corresponding to at least part of the bowling ball trajectory 213, whereby graphics representing at least part of the bowling ball trajectory 213 is projected onto the bowling lane 210 simultaneously with the graphics representing at least part of the intended bowling ball trajectory 211, 212.

An initial calibration may be performed in order to have the projecting arrangement and/or tracking arrangement aligned with the bowling lane. Optionally, the alignment, or mapping if you will, is performed continuously by projecting known calibration targets for the tracking arrangement to find. To find the boundaries of the bowling lane image recognition may be used. The calibration may also be performed in other ways not disclosed here within. The calibration as such is not explained in more detail and is considered to be known to a person skilled in the art.

Figure 3:
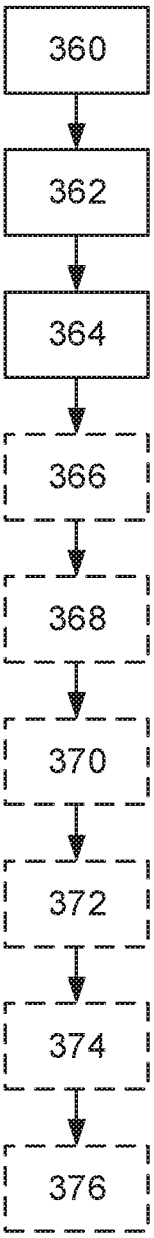
FIG. 3 illustrates a method for facilitating practice of bowling in a flow chart diagram.

A method for facilitating practice of bowling according to the inventive concept will now be described with reference to FIG. 3. For clarity and simplicity, the method will be described in terms of 'steps'. It is emphasized that steps are not necessarily processes that are delimited in time or separate from each other, and more than one 'step' may be performed at the same time in a parallel fashion.

The method comprises a step 360 of storing, in a data storing device, oil pattern data corresponding to a set of oil patterns for bowling lanes; a step 362 of sending, via a processing unit, from the data storing device to a projecting arrangement, oil pattern data corresponding to one oil pattern of said set of oil patterns; and a step of 364 of projecting, via the projecting arrangement, graphics representing the one oil pattern of said set of oil patterns onto the bowling lane.

The method may further comprise a step 366 of tracking movement, via a tracking arrangement, of a bowling ball on the bowling lane; a step 368 of generating, via the tracking arrangement, tracking data corresponding to a bowling ball trajectory; a step 370 of comparing, via the processing unit, the tracking data to the oil pattern data; a step of 372 of updating, via the processing unit, the oil pattern data in the data storing device based on the comparison; a step 374 of sending, via the processing unit, from the data storing device to the projecting arrangement, the updated oil pattern data, the updated oil pattern data corresponding to an adjusted oil pattern; and a step 376 of projecting graphics representing the adjusted oil pattern onto the bowling lane.

Figure 4:
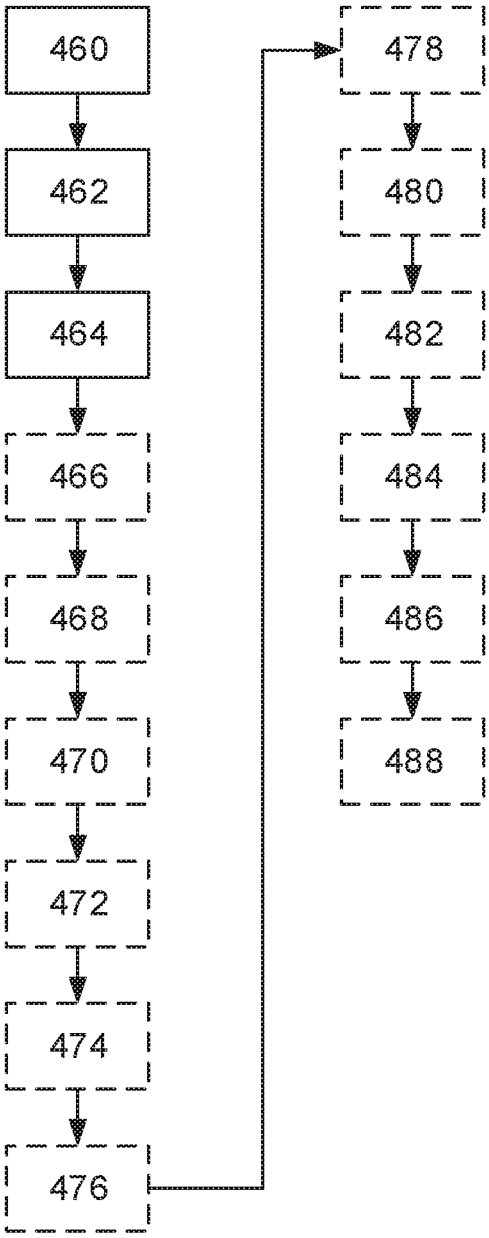
FIG. 4 illustrates another method for facilitating practice of bowling in a flow chart diagram.

A method for facilitating practice of bowling according to the inventive concept will now be described with reference to FIG. 4. For clarity and simplicity, the method will be described in terms of 'steps'. It is emphasized that steps are not necessarily processes that are delimited in time or separate from each other, and more than one 'step' may be performed at the same time in a parallel fashion.

The method comprises a step 460 of storing, via a data storing device, intended trajectory data corresponding to an intended bowling ball trajectory; a step 462 of sending, via a processing unit, from the data storing device to a projecting arrangement, intended trajectory data corresponding to at least part of the intended bowling ball trajectory; and a step 464 of projecting, via the projecting arrangement, graphics representing the at least part of the intended bowling ball trajectory onto the bowling lane.

The method may further comprise a step 466 of tracking, via a tracking arrangement, movement of a bowling ball on the bowling lane; and a step 468 of generating, via the tracking arrangement, tracking data corresponding to a bowling ball trajectory.

The method may further comprise a step 470 of comparing, via the processing unit, the intended trajectory data to the tracking data; a step 472 of generating, via the processing unit, based on the comparison, accuracy data; and a step 474 of presenting, via an interface, the generated accuracy data.

The method may further comprise a step 476 of generating the accuracy data which comprises determining a deviation in the bowling ball trajectory to the intended bowling ball trajectory.

The method may further comprise a step 478 of sending, via the processing unit, from the tracking arrangement to the projecting arrangement, tracking data corresponding to at least part of the bowling ball trajectory; and a step 480 of projecting graphics representing at least part of the bowling ball trajectory onto the bowling lane simultaneously with said projecting of graphics representing at least part of the intended bowling ball trajectory.

The method may further comprise a step 482 of receiving, at a graphical user interface, by a user, input data defining the intended bowling ball trajectory; and a step 484 of storing, in the storing device, the input data defining the intended trajectory as intended trajectory data.

The method may further comprise a step 486 of sending, via the processing unit, from the tracking arrangement to the graphical user interface, tracking data corresponding to at least part of the bowling ball trajectory and, from the storing device to the graphical user interface, intended trajectory data corresponding to at least part of the intended bowling ball trajectory, a step 488 of displaying on the graphical user interface, whereby graphics representing at least part of the bowling ball trajectory and graphics representing at least part of the intended bowling ball trajectory on the graphical user interface, are displayed on the graphical user interface.

The intended trajectory data may comprise a breakpoint of the bowling ball.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

Itemized List of Embodiments

1. A system for facilitating practice of bowling, wherein the system comprises:
   - a data storing device configured to store oil pattern data corresponding to a set of oil patterns for bowling lanes;
   - a projecting arrangement configured to project graphics onto a bowling lane; and
   - a processing unit configured to send, from the data storing device to the projecting arrangement, oil pattern data corresponding to one oil pattern of said set of oil patterns, whereby graphics representing the one oil pattern of said set of oil patterns is projected onto the bowling lane.
2. The system according to item 1, further comprising:
   - a tracking arrangement configured track movement of a bowling ball on the bowling lane and to generate tracking data corresponding to a bowling ball trajectory;

wherein the processing unit is further configured to compare the tracking data to the oil pattern data and to update the oil pattern data in the data storing device based on the comparison, the updated oil pattern data corresponding to an adjusted oil pattern; and wherein the processing unit is configured to send, from the data storing device to the projecting arrangement, the updated oil pattern data, whereby graphics representing the adjusted oil pattern is projected onto the bowling lane.

3. A system for facilitating practice of bowling, wherein the system comprises:

a data storing device configured to store intended trajectory data corresponding to an intended bowling ball trajectory;

a projecting arrangement configured to project graphics onto a bowling lane; and a processing unit configured to send, from the data storing device to the projecting arrangement, intended trajectory data corresponding to at least part of the intended bowling ball trajectory, whereby graphics representing at least part of the intended bowling ball trajectory is projected onto the bowling lane.

4. The system according to item 3, further comprising:

a tracking arrangement configured track movement of a bowling ball on the bowling lane and to generate tracking data corresponding to a bowling ball trajectory.

5. The system according to item 4, wherein the processing unit is further configured to compare the intended trajectory data to the tracking data and to, based on the comparison, generate accuracy data; and wherein the system further comprises:

an interface configured to present the generated accuracy data.

6. The system according to item 5, wherein the accuracy data represents a deviation in the bowling ball trajectory to the intended bowling ball trajectory.

7. The system according to item 4, wherein the processing unit is further configured to send, from the tracking arrangement to the projecting arrangement, tracking data corresponding to at least part of the bowling ball trajectory, whereby graphics representing at least part of the bowling ball trajectory is projected onto the bowling lane simultaneously with the graphics representing at least part of the intended bowling ball trajectory.

8. The system according to item 3, further comprising:

a graphical user interface configured to receive, by a user, input data defining the intended bowling ball trajectory;

wherein the data storing device is further configured to store the input data defining the intended bowling ball trajectory as intended trajectory data.

9. The system according to item 8, wherein the processing unit is further configured to send, from the tracking arrangement to the graphical user interface, tracking data corresponding to at least part of the bowling ball trajectory and, from the data storing device to the graphical user interface, intended trajectory data corresponding to at least part of the intended bowling ball trajectory, whereby graphics representing at least part of the bowling ball trajectory and graphics representing at least part of the intended bowling ball trajectory are displayed on the graphical user interface.

10. The system according to item 4, wherein the processing unit is further configured to send, from the tracking arrangement to a display, tracking data corresponding to at least part of the bowling ball trajectory and, from the data storing device to the graphical user interface, intended trajectory data corresponding to at least part of the intended bowling ball trajectory, whereby graphics representing at least part of the bowling ball trajectory and graphics representing at least part of the intended bowling ball trajectory are displayed on the graphical user interface.

11. The system according to item 3, wherein the intended trajectory data corresponding to an intended bowling ball trajectory comprises a breakpoint of the bowling ball when moving on the bowling lane.

12. A method for facilitating practice of bowling, wherein the method comprises:

storing, in a data storing device, oil pattern data corresponding to a set of oil patterns for bowling lanes;

sending, via a processing unit, from the data storing device to a projecting arrangement, oil pattern data corresponding to one oil pattern of said set of oil patterns; and projecting, via the projecting arrangement, graphics representing the one oil pattern of said set of oil patterns onto the bowling lane.

13. The method according to item 12, further comprising:

tracking movement, via a tracking arrangement, of a bowling ball on the bowling lane;

generating, via the tracking arrangement, tracking data corresponding to a bowling ball trajectory;

comparing, via the processing unit, the tracking data to the oil pattern data;

updating, via the processing unit, the oil pattern data in the data storing device based on the comparison;

sending, via the processing unit, from the data storing device to the projecting arrangement, the updated oil pattern data, the updated oil pattern data corresponding to an adjusted oil pattern; and projecting graphics representing the adjusted oil pattern onto the bowling lane.

14. A method for facilitating practice of bowling, wherein the method comprises:

storing, via a data storing device, intended trajectory data corresponding to an intended bowling ball trajectory;

sending, via a processing unit, from the data storing device to a projecting arrangement, intended trajectory data corresponding to at least part of the intended bowling ball trajectory; and projecting, via the projecting arrangement, graphics representing the at least part of the intended bowling ball trajectory onto the bowling lane.

15. The method according to item 14, further comprising:

tracking, via a tracking arrangement, movement of a bowling ball on the bowling lane; and generating, via the tracking arrangement, tracking data corresponding to a bowling ball trajectory.

16. The method according to item 15, further comprising:

comparing, via the processing unit, the intended trajectory data to the tracking data;

generating, via the processing unit, based on the comparison, accuracy data; and presenting, via an interface, the generated accuracy data.

17. The method according to item 16, wherein the step of generating the accuracy data comprises determining a deviation in the bowling ball trajectory to the intended bowling ball trajectory.

18. The method according to item 15, further comprising:

sending, via the processing unit, from the tracking arrangement to the projecting arrangement, tracking data corresponding to at least part of the bowling ball trajectory; and projecting graphics representing at least part of the bowling ball trajectory onto the bowling lane simultaneously with said projecting of graphics representing at least part of the intended bowling ball trajectory.

19. The method according to item 14, further comprising:

receiving, at a graphical user interface, by a user, input data defining the intended bowling ball trajectory; and storing, in the storing device, the input data defining the intended trajectory as intended trajectory data.

20. The method according to item 19, further comprising:

sending, via the processing unit, from the tracking arrangement to the graphical user interface, tracking data corresponding to at least part of the bowling ball trajectory and, from the storing device to the graphical user interface, intended trajectory data corresponding to at least part of the intended bowling ball trajectory;

displaying graphics representing at least part of the bowling ball trajectory and graphics representing at least part of the intended bowling ball trajectory on the graphical user interface.

21. The method according to item 14, wherein the intended trajectory data comprises a breakpoint of the bowling ball.

LIST OF REFERENCE SIGNS

100 System
101 Data storing device
102 Projecting arrangement
103 Processing unit
104 Tracking arrangement
105 Interface
110 Bowling lane
111 Oil pattern
200 System
201 Data storing device
202 Projecting arrangement
203 Processing unit
204 Tracking arrangement
205 Interface
210 Bowling lane
211 Intended bowling ball trajectory
212 Intended bowling ball trajectory
213 Bowling ball trajectory

The invention claimed is:

1. A system for facilitating practice of bowling, wherein the system comprises:

a data storing device configured to store oil pattern data corresponding to a set of oil patterns for bowling lanes;

a projecting arrangement configured to project graphics onto a bowling lane;

a processing unit configured to send, from the data storing device to the projecting arrangement, oil pattern data corresponding to one oil pattern of said set of oil patterns, whereby graphics representing the one oil pattern of said set of oil patterns is projected onto the bowling lane; and a tracking arrangement configured to track movement of a bowling ball on the bowling lane and to generate tracking data corresponding to a bowling ball trajectory, wherein the processing unit is further configured to:

compare the tracking data to the oil pattern data;

update the oil pattern data stored in the data storing device based on the comparison, the updated oil pattern data corresponding to an adjusted oil pattern; and send, from the data storing device to the projecting arrangement, the updated oil pattern data, whereby graphics representing the adjusted oil pattern is projected onto the bowling lane.

2. The system according to claim 1, wherein the data storing device is configured to store intended trajectory data corresponding to an intended bowling ball trajectory; and the processing unit is configured to send, from the data storing device to the projecting arrangement, intended trajectory data corresponding to at least part of the intended bowling ball trajectory, whereby graphics representing at least part of the intended bowling ball trajectory is projected onto the bowling lane.

3. The system according to claim 2, wherein the processing unit is further configured to compare the intended trajectory data to the tracking data and to, based on the comparison, generate accuracy data; and wherein the system further comprises:

an interface configured to present the generated accuracy data.

4. The system according to claim 3, wherein the accuracy data represents a deviation in the bowling ball trajectory to the intended bowling ball trajectory.

5. The system according to claim 2, wherein the processing unit is further configured to send, from the tracking arrangement to the projecting arrangement, tracking data corresponding to at least part of the bowling ball trajectory, whereby graphics representing at least part of the bowling ball trajectory is projected onto the bowling lane simultaneously with the graphics representing at least part of the intended bowling ball trajectory.

6. The system according to claim 2, further comprising:

a graphical user interface configured to receive, from a user, input data defining the intended bowling ball trajectory;

wherein the data storing device is further configured to store the input data defining the intended bowling ball trajectory as intended trajectory data.

7. The system according to claim 6, wherein the processing unit is further configured to send, from the tracking arrangement to the graphical user interface, tracking data corresponding to at least part of the bowling ball trajectory and, from the data storing device to the graphical user interface, intended trajectory data corresponding to at least part of the intended bowling ball trajectory, whereby graphics representing at least part of the bowling ball trajectory and graphics representing at least part of the intended bowling ball trajectory are displayed on the graphical user interface.

8. The system according to claim 2, wherein the processing unit is further configured to send, from the tracking arrangement to a display, tracking data corresponding to at least part of the bowling ball trajectory and, from the data storing device to the display, intended trajectory data corresponding to at least part of the intended bowling ball trajectory, whereby graphics representing at least part of the bowling ball trajectory and graphics representing at least part of the intended bowling ball trajectory are displayed on the display.

9. The system according to claim 2, wherein the intended trajectory data corresponding to an intended bowling ball trajectory comprises a breakpoint of the bowling ball when moving on the bowling lane.

10. The system according to claim 1, wherein the tracking arrangement is further configured to track movement of several bowling balls on the bowling lane and to generate tracking data corresponding to a respective bowling ball trajectory of each bowling ball of the several bowling balls.

11. The system according to claim 1, wherein the processing unit is configured to, based on the comparison between the tracking data and the oil pattern data, generate an indication of a need of maintenance of the oil pattern.

12. The system according to claim 1, wherein the processing unit is further configured to update the oil pattern data in the data storing device based on a factor defining an effect of the bowling on oil of the oil pattern.

13. The system according to claim 12, wherein the factor is at least one of an amount of oil sticking to the bowling ball when moving along an oiled surface, and an amount of oil releasing from the bowling ball when moving along a non-oiled surface.

14. A system for facilitating practice of bowling, wherein the system comprises:

a data storing device configured to store oil pattern data corresponding to a set of oil patterns for bowling lanes;

a projecting arrangement configured to project graphics onto a bowling lane;

a processing unit configured to send, from the data storing device to the projecting arrangement, oil pattern data corresponding to one oil pattern of said set of oil patterns, whereby graphics representing the one oil pattern of said set of oil patterns is projected onto the bowling lane, and a tracking arrangement configured to track movement of a first bowling ball on the bowling lane and to generate first tracking data corresponding to a bowling ball trajectory of the first bowling ball;

wherein the processing unit is further configured to compare the first tracking data to the oil pattern data and to update the oil pattern data in the data storing device based on the comparison, the updated oil pattern data corresponding to a first adjusted oil pattern;

wherein the tracking arrangement is further configured to track movement of a second bowling ball on the bowling lane and to generate second tracking data corresponding to a bowling ball trajectory of the second bowling ball;

wherein the processing unit is further configured to compare the second tracking data to the updated oil pattern data and to further update the updated oil pattern in the data storing device based on the comparison, the further updated pattern data corresponding to a second adjusted oil pattern;

wherein the processing unit is configured to send, from the data storing device to the projecting arrangement, the further updated oil pattern data, whereby graphics representing the second adjusted oil pattern is projected onto the bowling lane.

15. A system for facilitating practice of bowling, wherein the system comprises:

a data storing device configured to store oil pattern data corresponding to a set of oil patterns for bowling lanes;

a processing unit configured to cause oil pattern data corresponding to one oil pattern of said set of oil patterns to be displayed on a display of a mobile device in communication with the processing unit, the oil pattern data being displayed as graphics representing the one oil pattern of said set of oil patterns; and a tracking arrangement configured track movement of a bowling ball on the bowling lane and to generate tracking data corresponding to a bowling ball trajectory;

wherein the processing unit is further configured to:

compare the tracking data to the oil pattern data and to update the oil pattern data in the data storing device based on the comparison, the updated oil pattern data corresponding to an adjusted oil pattern; and cause the updated oil pattern data to be displayed as graphics representing the adjusted oil pattern on the display of the mobile device.

* * * * *